United States Patent [19]

Marrello et al.

[11] 4,275,336

[45] Jun. 23, 1981

[54] METHOD OF IMPROVING THE MEMORY EFFECT AND BRIGHTNESS OF AN ALTERNATING CURRENT EXCITED THIN FILM ELECTROLUMINSCENT DEVICE

[75] Inventors: Vincent Marrello, San Jose; Aare Onton, Saratoga, both of Calif.; Wolfgang Rühle, Stuttgart, Fed. Rep. of Germany

[73] Assignee: International Business Machines Corporation, Armonk, N.Y.

[21] Appl. No.: 974,180

[22] Filed: Mar. 5, 1979

[51] Int. Cl.[3] ..... H05B 33/08

[52] U.S. Cl. ..... 315/246; 315/169.3

[58] Field of Search ..... 315/169.3, 246; 340/781, 760, 805

[56] References Cited

U.S. PATENT DOCUMENTS

| | | | |
|---|---|---|---|
| 2,922,076 | 1/1960 | Sack et al. | 315/71 |
| 2,972,694 | 2/1961 | Thornton, Jr. | 315/246 |
| 3,021,387 | 2/1962 | Rajchman | 313/505 |
| 3,048,824 | 8/1962 | Thompson | 315/169.3 |
| 3,246,162 | 4/1966 | Chin | 315/169.3 |
| 3,350,506 | 10/1967 | Chetnow | 315/169.3 |
| 3,393,346 | 7/1968 | Lechner et al. | 315/166 |
| 3,452,199 | 6/1969 | Stahlhut | 340/786 X |
| 3,521,244 | 7/1970 | Weimer | 250/209 X |
| 3,550,095 | 12/1970 | Kohashi | 313/463 |
| 3,651,493 | 3/1972 | Ngo | 340/781 |
| 3,869,646 | 3/1975 | Kerton et al. | 315/246 |
| 3,946,371 | 3/1976 | Inazaki et al. | 340/718 |
| 4,024,389 | 5/1977 | Kanatami et al. | 250/213 R |

FOREIGN PATENT DOCUMENTS

| | | | |
|---|---|---|---|
| 46-428571 | 2/1971 | Japan | 315/169.3 |

OTHER PUBLICATIONS

Hakki, Solid-State Acoustoelectric Light Scanner, Applied Physics Letters, vol. 11, No. 5, Sep. 1, 1967, pp. 153-155.

*Primary Examiner*—Eugene R. La Roche
*Attorney, Agent, or Firm*—Joseph E. Kieninger

[57] ABSTRACT

A method for improving the memory effect and brightness of an alternating current (AC) excited thin film electroluminensence (ACTEL) device is described. A typical ACTEL device has a thin luminescent layer made of ZnS thin film doped with Mn which is sandwiched between two dielectric layers. ACTEL devices exhibit a brightness versus voltage amplitude hysteresis loop which is commonly referred to as the memory effect. The application of a hybrid AC excitation waveform to the ACTEL device provides increased brightness and improved memory effect stability. The hybrid waveform has an initial portion that is sufficiently high for efficient carrier generation and a remaining waveform portion that is at a lower level than the initial portion for charge collection and holding purposes.

7 Claims, 7 Drawing Figures

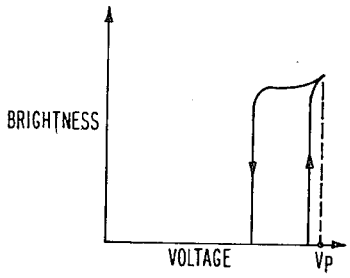
FIG. 1 MEMORY EFFECT
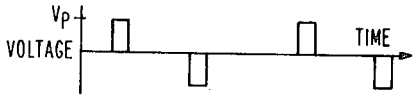
FIG. 2 PRIOR ART-PULSED MODE
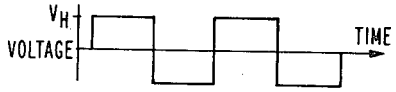
FIG. 3 PRIOR ART-SQUARE WAVE
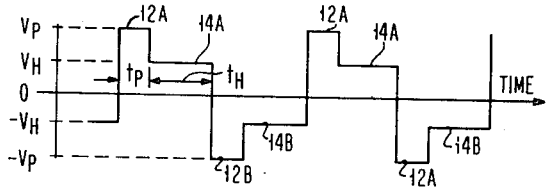
FIG. 4
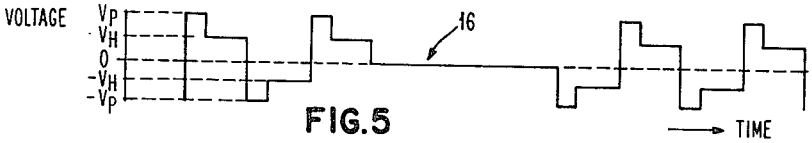
FIG. 5
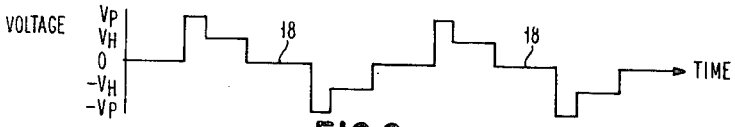
FIG. 6
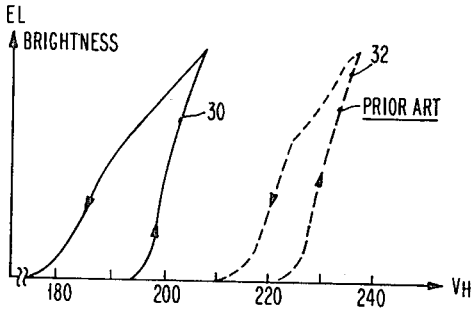
FIG. 7

METHOD OF IMPROVING THE MEMORY EFFECT AND BRIGHTNESS OF AN ALTERNATING CURRENT EXCITED THIN FILM ELECTROLUMINSCENT DEVICE

DESCRIPTION

Technical Field

This invention relates to alternating current excited thin film electroluminescent (ACTEL) devices and more particularly to a method for improving the memory effect and brightness of this type of device.

It is a primary object of this invention to provide an improved method of operating an ACTEL device.

It is another object of this invention to provide an improved method for providing an ACTEL device having a wider memory loop width.

It is yet another object of this invention to provide an improved method for providing an ACTEL device with a slower memory decay time period.

It is a further object of this invention to provide an improved method for providing an ACTEL device with a higher brightness for equivalent stress of the device.

BACKGROUND ART

The inherent memory effect in ACTEL devices is responsible for the present high level of interest in the Mn doped ZnS ACTEL devices. Typically, the ACTEL device consists of a layer of ZnS:Mn film having a thickness of 0.5 $\mu$m to 1.0 $\mu$m that is sandwiched by a pair of dielectric layers of approximately the same total thickness as the ZnS. Various dielectric materials have been used such as amorphous $BaTiO_3$. This structure is sandwiched between two conductors of which at least one is partially transparent.

An ACTEL device exhibits a brightness versus voltage amplitude hysteresis loop which is commonly referred to as a memory effect and as is shown in FIG. 1. The memory effect is characterized by a well-defined AC voltage threshold amplitude at which the luminescence begins and which reaches its maximum at $V_P$. Once the voltage amplitude has been increased to a point where electroluminescence is obtained, the extinction of the luminescence occurs at a lower voltage amplitude. Between the extinction and turn-on voltage amplitudes, the device possesses a continuum of stable brightness states where the brightness of these states depends upon the voltage amplitude history.

This memory effect has been demonstrated with sine wave, square wave and pulse excitations where the pulses alternate in polarity. FIG. 2 is an example of a pulse mode of excitation. The pulse mode has the advantage of attaining a high brightness and it causes a low stress level in the device. However, a pulse mode of operation has the disadvantage of a fast memory decay.

FIG. 3 shows a square wave mode of operation which is also used in the prior art. The square wave mode has the advantage of a slow memory decay. It has the disadvantage of a lower brightness and higher stress characteristics on the ACTEL device.

BRIEF DESCRIPTION OF THE DRAWINGS

In the accompanying drawings forming a material part of this disclosure:

FIG. 1 is a diagram illustrating the memory effect of an ACTEL device;

FIG. 2 is a diagram showing the pulse mode of alternating current as used in the prior art;

FIG. 3 is a diagram illustrating the square wave mode of alternating current used in the prior art;

FIG. 4 is a hybrid waveform excitation according to this invention;

FIG. 5 is a hybrid waveform excitation in bursts;

FIG. 6 is a hybrid waveform excitation in a pulse mode.

FIG. 7 is a plot of device brightness versus voltage amplitude, $V_H$, for a prior art square waveform and a hybrid waveform excitation.

DISCLOSURE OF INVENTION

For a further understanding of the invention and of the objects and advantages thereof, reference will be had to the following description and accompanying drawings, and to the appended claims in which the various novel features of the invention are more particularly set forth.

A method for improving the memory effect and brightness of an alternating current (AC) excited thin film electroluminescence (ACTEL) device is described. A typical ACTEL device has a thin luminescent layer made of ZnS thin film doped with Mn which is sandwiched between two dielectric layers of a material such as amorphous $BaTio_3$. This structure is sandwiched between two conductors of which at least one is partially transparent. ACTEL devices exhibit a brightness versus voltage amplitude hystersis loop which is commonly referred to as the memory effect. The application of a hybrid AC excitation waveform to the ACTEL device provides increased brightness and improved memory effect stability. The hybrid waveform has an initial rise pulse portion that is sufficiently high for carrier generation. The level of this first portion must be lower than the device breakdown voltage under pulsed excitation. The initial portion lasts for a period of time ranging from 200 ns to 10 $\mu$s. The remaining waveform portion is at a lower level than the initial portion and is primarily for charge collection and holding purposes. The second voltage level portion is at a voltage that is below the DC device breakdown voltage. The remaining waveform portion is maintained for a time ranging from 10 $\mu$s to about 1 s.

BEST MODE FOR CARRYING OUT THE INVENTION

A hybrid AC excitation square waveform with an initial rise pulse as shown in FIG. 4, is applied to the ACTEL device. The first voltage level portion 12A of the waveform has a voltage level $V_P$. $V_P$ is a voltage that is sufficiently high to obtain electroluminescent brightness, but lower than the device breakdown voltage under pulsed excitation. The first voltage level portion 12A is maintained for a time $t_P$. Preferably, the time $t_P$ ranges from 200 ns to 10 $\mu$s.

The second voltage level portion 14A is at a voltage level lower than the first portion and is for charge collection and holding purposes. The second voltage level portion is at a voltage that is below the DC device breakdown voltage. Generally, the DC device breakdown voltage for dielectrics is lower than that for pulsed excitation. The second voltage level portion is maintained for a time $t_H$. The time $t_H$ preferably ranges from 10 $\mu$s to 1 s. The hybrid waveform shown in FIG. 4 increases the brightness and improves the memory effect stability.

Each positive hybrid waveform 12A and 14A is followed by a negative hybrid waveform having portions 12B and 14B. The negative hybrid waveform is the same size and shape as the positive hybrid waveform.

Applying the hybrid AC excitation waveform shown in FIG. 4 to an ACTEL device yields an increased memory loop width of the order of 50%, an increased brightness for a given stress on the dielectric of about 100%, a significant improvement in the contrast ratio, and a more stable on-state memory. This method also provides for a sharper onset of the luminescence versus voltage amplitude, $V_H$.

FIG. 5 is an alternative embodiment illustrating a hybrid square waveform with an initial rise pulse in bursts. FIG. 5 is similar to FIG. 4 except that FIG. 5 includes an off period 16.

FIG. 6 is an alternative embodiment of a hybrid square wave with an initial rise pulse in a pulse mode. It is similar to FIG. 4 except that it has a time off period 18 located between the positive and negative voltage waveforms.

In FIGS. 4–6 the overshoot portion of the excitation waveform, extending to $V_P$, is shown in an idealized fashion as a square pulse. However, any monotonically rising and decaying pulse shape in the time $t_P$ and of amplitude $V_P$ will be effective in producing similar advantages. For the purpose of this disclosure, all such pulse shapes are included in the claim.

INDUSTRIAL APPLICABILITY

The advantages of this method in applying a hybrid AC excitation waveform to ACTEL devices is that it increases the brightness and it improves the memory effect stability. This method retains the advantages of a pulse mode operation and a square waveform mode while eliminating the disadvantages of these two modes.

In addition, these advantages are possible while still lowering the stress on the device.

EXAMPLE 1

An ACTEL device having a ZnS:Mn layer 0.6 μm thick and containing 0.6 atomic % Mn was sandwiched between two amorphous $BaTiO_3$ layers that are each about 0.5 μm thick. A transparent base indium-tin oxide electrode and a top aluminum electrode completed the device.

A square wave hybrid waveform of the type shown in FIG. 4 was applied. With $t_P=300$ ns, and $t_H=100$ μs, the $V_P$ was equal to 1.2 $V_H$ and $V_H$ was varied as shown as curve 30 in FIG. 7. A prior art square wave waveform of the type shown in FIG. 3 was applied in a similar manner to yield curve 32.

In accordance with this invention, curve 30 indicates that the memory loop width was 60% greater than prior art curve 32. For the same $V_H$ using the square wave hybrid waveform, the brightness (not shown) was 100% greater than prior art curve 32. The contrast ratio defined as the on-brightness to the off-brightness for a voltage within curve 30 is higher than in prior art curve 32. The stability of the on-state memory brightness was longer for curve 30 than for curve 32.

Although the invention stated herein is in terms of an ACTEL device exhibiting the memory effect, the same hybrid waveform will also produce advantages in the operation of ACTEL devices not exhibiting the memory effect. In non-memory devices the advantages of higher brightness and lower device stress are obtained when operated with the hybrid waveform.

While I have illustrated and described the preferred embodiments of my invention, it is understood that I do not limit myself to the precise constructions herein disclosed and the right is reserved to all changes and modifications coming within the scope of the invention as defined in the appended claims.

We claim:

1. A method of improving an AC excited thin film electroluminescence device comprising the steps of applying a hybrid waveform excitation to said device, said hybrid waveform having a first voltage level portion for carrier generation and a second voltage level portion lower than said first level for charge collection and holding purposes only.

2. A method as described in claim 1 wherein said first voltage level portion is at a voltage that is sufficient to obtain brightness and that is lower than the device breakdown voltage.

3. A method as described in claim 1 whereby said first voltage level portion is maintained for a time ranging from 200 ns to 10μ sec.

4. A method as described in claim 1 whereby said second voltage level portion is at a voltage that is below the DC device breakdown voltage.

5. A method as described in claim 1 whereby said second voltage level portion is maintained for a time ranging from 10 μs to 1 s.

6. A method as described in claim 1 whereby said hybrid waveform is applied in a pulsed mode.

7. A method as described in claim 1 whereby said hybrid waveform is applied in a burst mode.

* * * * *